US009950352B2

(12) United States Patent
Ahlquist

(10) Patent No.: US 9,950,352 B2
(45) Date of Patent: Apr. 24, 2018

(54) FAUCET CLEANER

(71) Applicant: Bryan Jay Ahlquist, St. Petersburg, FL (US)

(72) Inventor: Bryan Jay Ahlquist, St. Petersburg, FL (US)

( * ) Notice: Subject to any disclaimer, the term of this patent is extended or adjusted under 35 U.S.C. 154(b) by 0 days.

(21) Appl. No.: 15/339,179

(22) Filed: Oct. 31, 2016

(65) Prior Publication Data

US 2017/0120310 A1 May 4, 2017

Related U.S. Application Data

(60) Provisional application No. 62/248,601, filed on Oct. 30, 2015.

(51) Int. Cl.

| | |
|---|---|
| ***A47K 1/04*** | (2006.01) |
| ***B08B 9/00*** | (2006.01) |
| ***A47L 25/00*** | (2006.01) |
| ***B08B 1/00*** | (2006.01) |

(52) U.S. Cl.

CPC ..... *B08B 9/00* (2013.01); *B08B 1/00* (2013.01); *B08B 1/002* (2013.01); *A47K 1/04* (2013.01); *A47L 25/00* (2013.01)

(58) Field of Classification Search

CPC combination set(s) only.

See application file for complete search history.

(56) References Cited

U.S. PATENT DOCUMENTS

| | | | | | |
|---|---|---|---|---|---|
| 2,608,705 | A * | 9/1952 | Duff | A63B 47/04 | 15/160 |
| 3,087,189 | A * | 4/1963 | Scanlon | A63B 47/04 | 401/11 |
| 4,210,974 | A * | 7/1980 | Stoltzman | A63B 47/04 | 15/21.2 |
| 4,225,253 | A * | 9/1980 | Fraleigh | B05C 17/002 | 101/379 |
| 5,056,946 | A * | 10/1991 | Larkin | A63B 47/04 | 401/11 |
| 6,736,562 | B2 * | 5/2004 | Whitmore | A47K 5/12 | 222/192 |

* cited by examiner

*Primary Examiner* — David Walczak

(74) *Attorney, Agent, or Firm* — Dunlap Bennett & Ludwig PLLC

(57) ABSTRACT

A faucet cleaner. The faucet cleaner includes a supply bottle having a base, a sidewall extending from the base, and a neck. The neck includes a top end having a rim forming an opening into the supply bottle. A delivery cup is secured to the neck of the supply bottle. The delivery cup includes a base and a sidewall extending from the base. A channel runs from inside the supply bottle through the opening formed by the rim of the neck, through the base of the pump mechanism and into delivery cup so that the top end is disposed in the delivery cup. A plurality of bristles are secured to the base of the delivery cup and disposed within the delivery cup.

8 Claims, 6 Drawing Sheets

FAUCET CLEANER

CROSS-REFERENCE TO RELATED APPLICATION

This application claims the benefit of priority of U.S. provisional application No. 62/248,601, filed Oct. 30, 2015, the contents of which are herein incorporated by reference.

BACKGROUND OF THE INVENTION

The present invention relates to faucets and, more particularly, to a faucet cleaner.

Mold grows on faucet spouts. Because the mold resides on the faucet strainer and inside the tip of every faucet, it is not readily possible to eliminate this growth without delivering a cleaning solution up and into the faucet.

Presently, there are no other devices designed to deliver a cleaning solution to eliminate the mold growth inside the tip of a faucet. Presently, a person would have to place caustic cleaning solutions on sponges or rags and attempt to force liquid up into a faucet.

As can be seen, there is a need for devices designed to deliver a cleaning solution to eliminate the mold growth inside the tip of a faucet.

SUMMARY OF THE INVENTION

In one aspect of the present invention, a faucet cleaner comprises: a supply bottle comprising a base, a sidewall extending from the base and a neck extending from the sidewall, wherein the neck comprises a top end comprising a rim forming an opening into the supply bottle; a delivery cup secured to the neck, wherein the delivery cup comprises a base and a sidewall extending from the base, wherein the sidewall comprises a top end comprising a rim forming an opening into the delivery cup; a channel comprising a bottom end and a top end, wherein the bottom end is disposed in the supply bottle, wherein the channel runs from inside the supply bottle through the opening formed by the rim of the neck, through a one way pump mechanism at the base of the delivery cup, wherein the top end is disposed in the delivery cup; and a plurality of bristles secured to the base of the delivery cup and disposed within the delivery cup.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a device designed to deliver a controlled amount of cleaning solution to reach water faucet spouts in sinks and shower heads to remove mold and bacteria. The present invention delivers a cleaning agent to a cup like apparatus that contains a small scrubbing surface. The device is introduced to the faucet area. The device dispenses a controlled amount of cleaning solution in the cup and the specially designed cleaning surface squeezes the solution into the faucet and scrubs off the mold residue. Once the faucet is cleaned, it allows for the faucet to be flushed by capturing the water from the faucet in the cup.

The cup retains the cleaning liquid. The cup material may be made of a flexible plastic to allow for it to be slightly deformed or re-shaped when pressing up onto a faucet. The bristles are used to scrub away any mold residue. The swivel bracket is used to accommodate small sink areas. A single directional pump is used to prevent the cleaning solution from being diluted with water from the cup.

Figure 1:
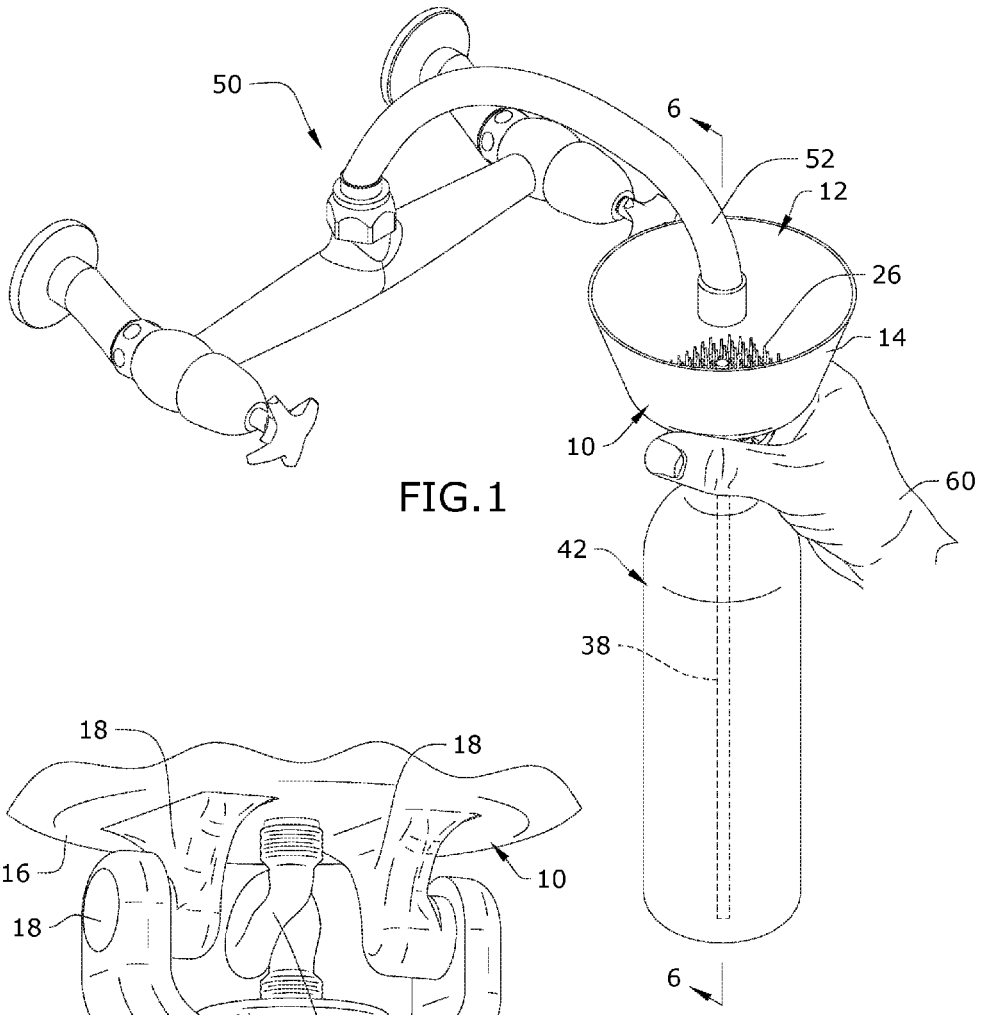
FIG. 1 is a perspective view of an embodiment of the present invention shown in use.
Figure 2:
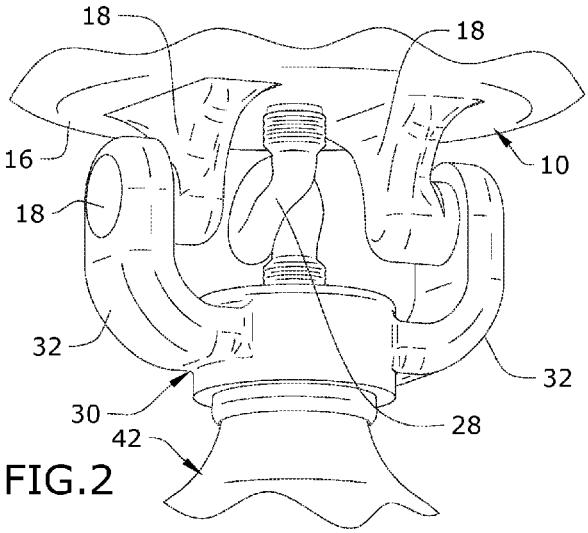
FIG. 2 is a detail lower perspective view of an embodiment of the present invention.
Figure 3:
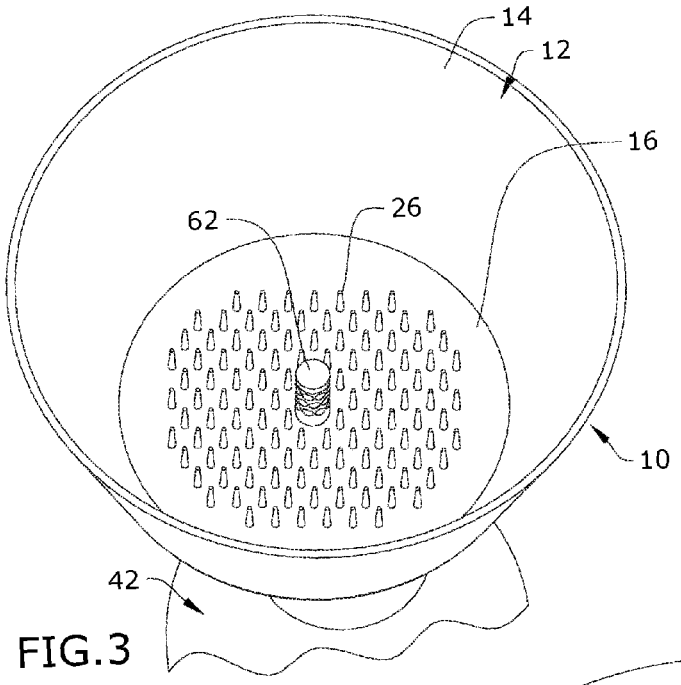
FIG. 3 is a top detail perspective view of an embodiment of the present invention.
Figure 4:
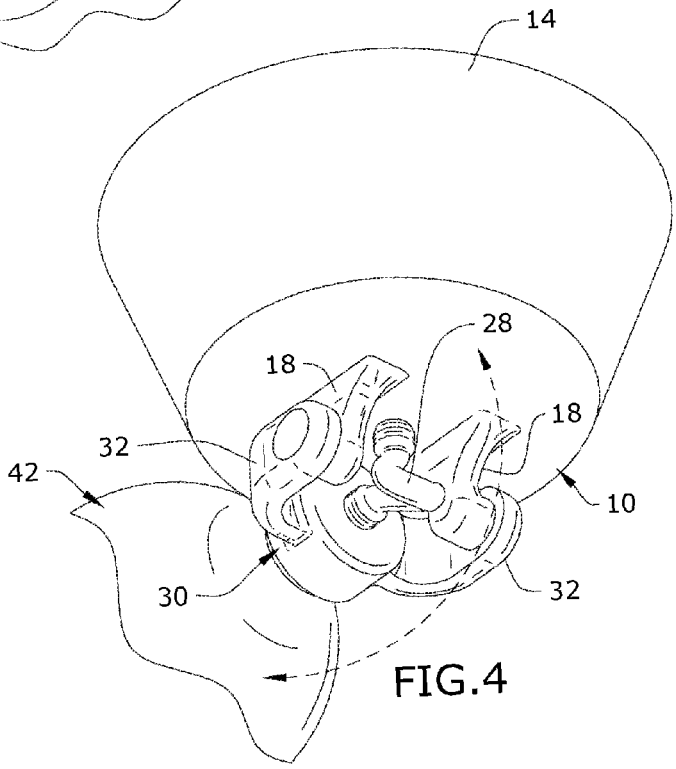
FIG. 4 is a bottom detail perspective view of an embodiment of the present invention illustrated in a rotated state.
Figure 5:
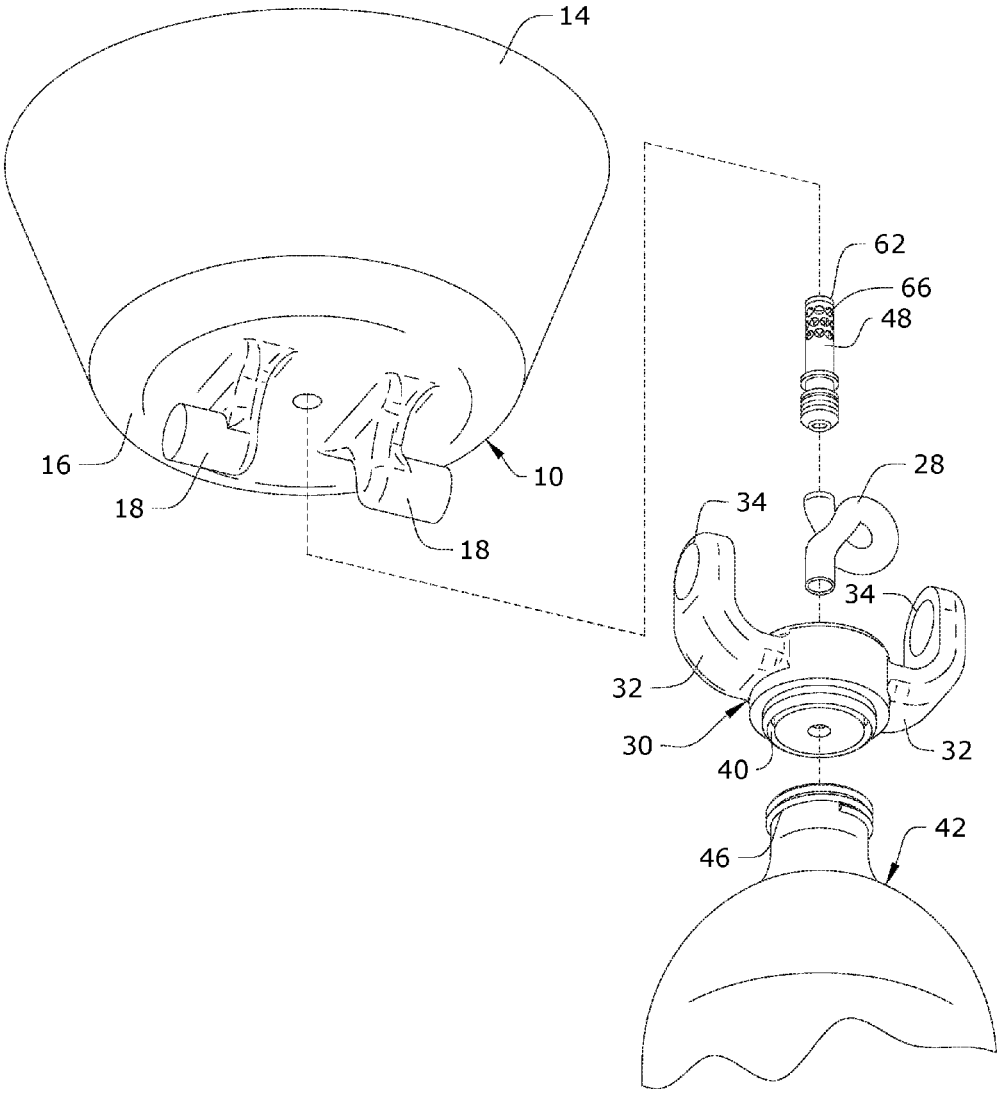
FIG. 5 is an exploded view of an embodiment of the present invention.
Figure 6:
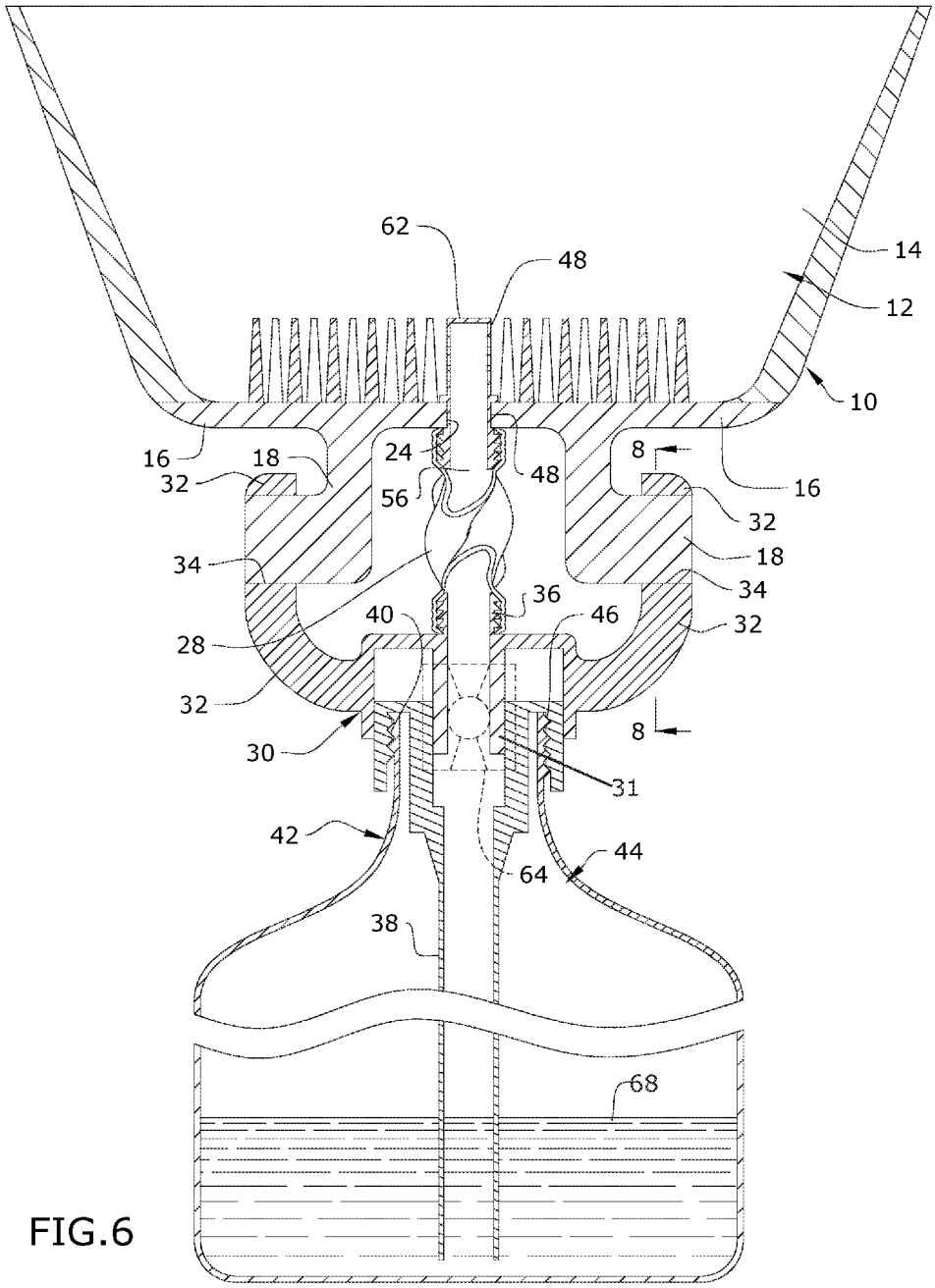
FIG. 6 is a section detail view of the present invention along line 6-6 in FIG. 1.
Figure 7:
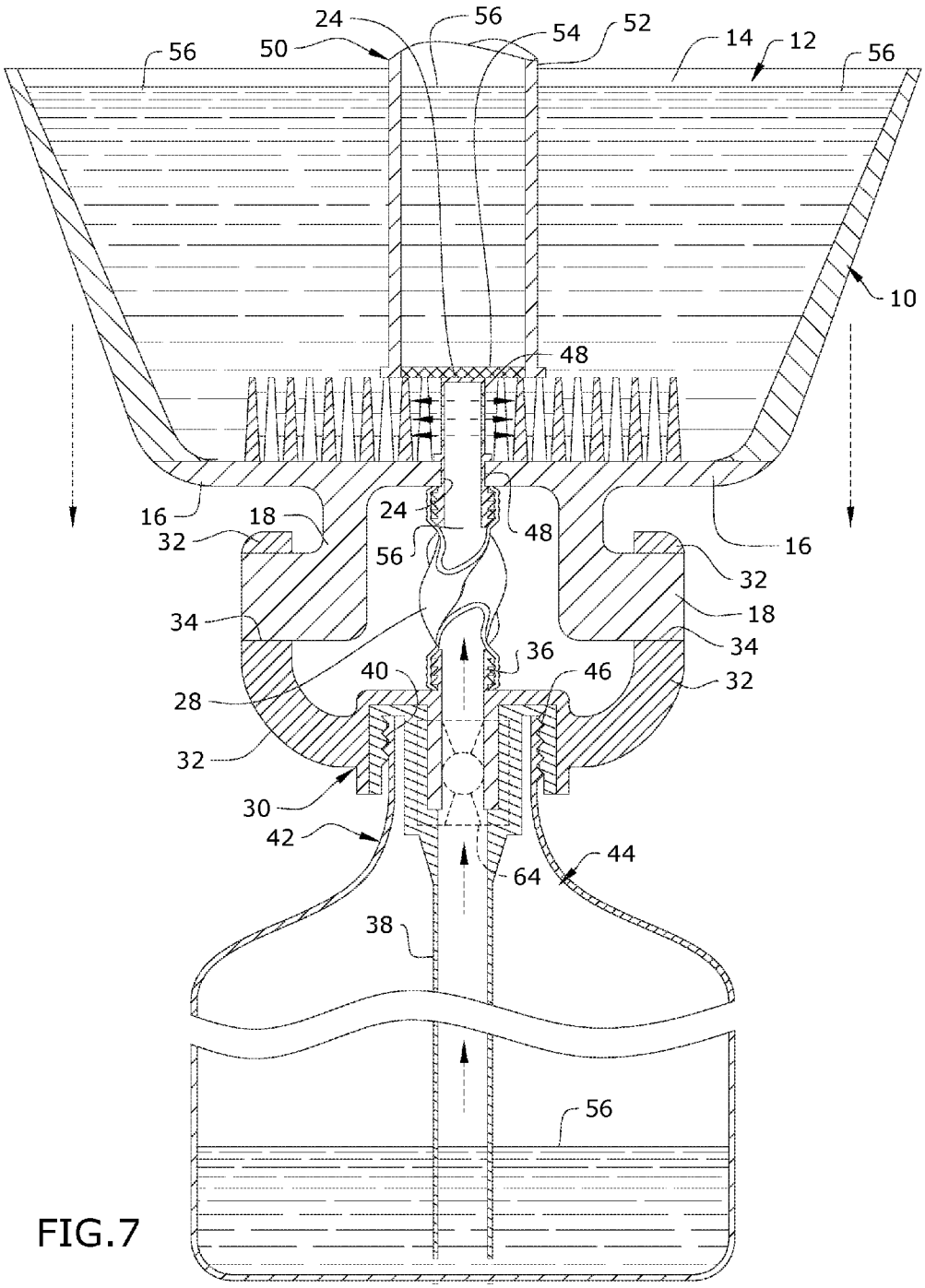
FIG. 7 is a section detail view of an embodiment of the present invention shown in use.
Figure 9:
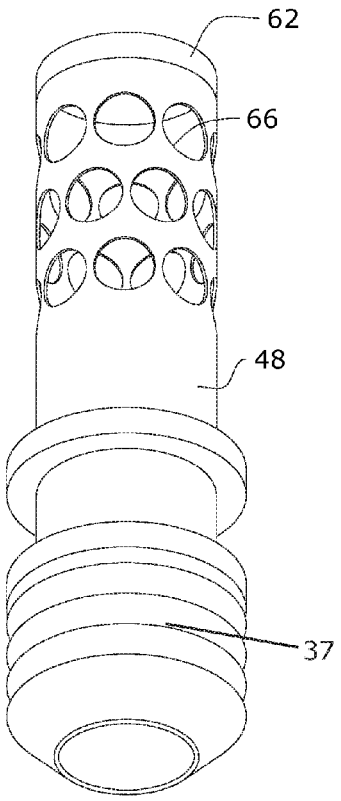
FIG. 9 is a section detail view of an embodiment of the present invention.
Figure 8:
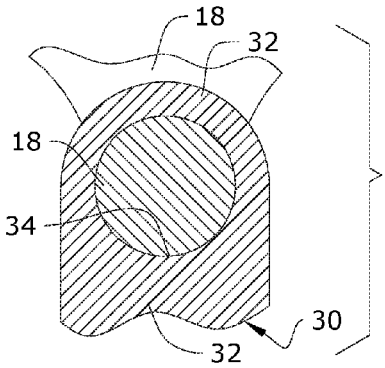
FIG. 8 is a section detail view of the present invention taken along line 8-8 in FIG. 6.
Figure 10:
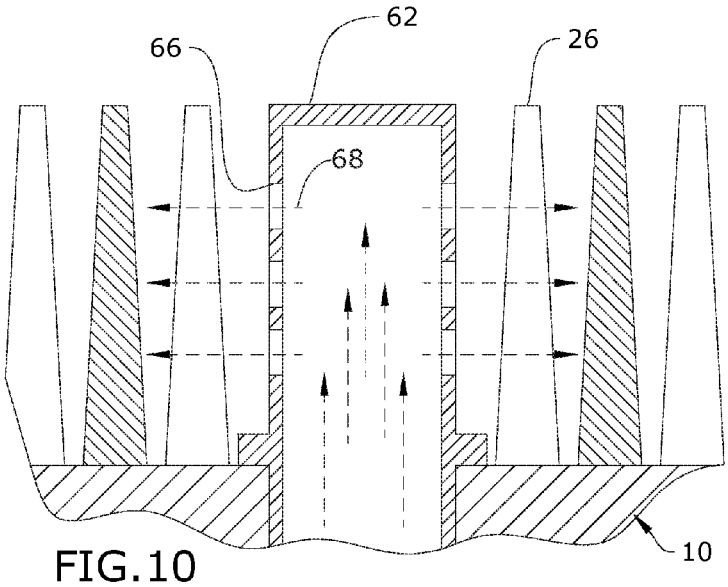
FIG. 10 is a section detail view of an embodiment of the present invention.

Referring to FIGS. 1 through 10, the present invention includes a faucet cleaner. The faucet cleaner includes a supply bottle 42. The supply bottle 42 includes a base, a sidewall extending from the base, and a neck. A liquid cavity 44 is in between the base, sidewall and neck. The neck includes a top end having a rim forming an opening into the cavity 44. The present invention further includes a delivery cup 10. The delivery cup 10 is secured to the neck of the supply bottle 42. The delivery cup 10 includes a base 16 and a sidewall 14 extending from the base 16 and forming a cavity 12 within. The sidewall 14 includes a top end having a rim forming an opening into the cavity 12. The present invention further includes a channel 56 having a bottom end and a top end. The bottom end is disposed in the supply bottle 42. The channel 56 runs from inside the supply bottle 42 through the opening formed by the rim of the neck, through the base 16 of the delivery cup 10 so that the top end is disposed in the delivery cup 10. A plurality of bristles 26 are secured to the base 16 of the delivery cup 10 and disposed within the delivery cup 10.

The supply bottle 42 of the present invention is a type of container for dispensing a fluid 68, that is powered by pumping the upper aperture downward with the user's hand 60. Its fundamental characteristic is that manual pressure applied downward in order to activate the pump section forces the fluid through the opening formed in the neck. The supply bottle 42 may be made of a flexible polymer, such as plastic. In certain embodiments, the neck may taper from the sidewall. An outer surface of the neck may include male threads 46.

In certain embodiments, the present invention further includes a bracket 30. The bracket 30 may secure to the neck of the supply bottle 42. The bracket 30 may include a pair of arms 32 extending upward and away from the supply bottle 42. Each of the pair of arms 32 may include pivot openings 34. A pair of pivot arms 18 may extend from a lower surface of the base 16 of the delivery cup 10. The pivot arms 18 fit within the pivot openings 34. Therefore, the reservoir cup 10 may pivot about a horizontal axis running through the pivot arms 18 to access different types of faucets 50 having low faucet stems 52.

As mentioned above, the delivery cup 10 of the present invention includes a base 16 and a sidewall 14 extending form the base 16. In certain embodiments, the base 16 may be made of a rigid material and the sidewall 14 may be made of a flexible material with a rubber elasticity. In certain embodiments, the sidewall 14 includes a frusto conical shape. For example, the sidewall 14 may taper from the bottom end to the top end so that the bottom end has a smaller diameter than the top end, providing a wide opening into the cavity 12.

In certain embodiments, the channel 56 may be formed by multiple parts. A stem 38 may be disposed within the cavity 44 of the supply bottle 42. The stem 38 may include a top end having female threads 40 mechanically secured to the male threads 46 of the neck of the supply bottle 42. The stem 38 may further include a one directional pump 64, which prevents liquid from coming back into the cavity 44 once expelled. The bracket 30 of the present invention may further include a bracket channel 31 and a bracket tube connector 36. The channel 56 may further be formed by the bracket channel 31 connected to the top end of the stem 38. The bracket tube connector 36 extends from a top end of the bracket channel 31. The channel 56 may further include a flexible tubing 28 having a bottom end connected to the bracket tube connector 36. The channel 56 may further include a supply tube 48 including a supply tube connector 37 at the bottom end and a nozzle at the top end 62 disposed in the delivery cup 10. The top end of the flexible tubing 28 is connected to the supply tube connector 37 of the supply tube 48.

The supply tube 48 of the present invention may be secured within an opening 24 formed in the base 16 of the delivery cup 10. In such embodiments, the supply tube connector 37 extends from the lower surface of the base 16 and the nozzle extends into the cavity 12 of the delivery cup 10. The nozzle may be disposed in between the bristles 26, such as at a center of the bristles 26. In certain embodiments, the nozzle may include a closed top end 62. The nozzle may further include a plurality of openings 66 positioned to deliver a liquid 68 laterally into the bristles 26.

The device works by providing a self-contained amount of cleaning liquid 68 to delivery cup 10. The process starts by pressing the body of the device in a downward motion pumping a small amount of cleaning liquid through the pump 64 and into the flexible tube 28. The flexible tube 28 delivers the liquid 68 through supply tube 48. The nozzle of the supply tube 48 is situated at the base 16 of the flexible delivery cup 10. Inside the base 16 of the cup 10 are small plastic bristles 16 (similar to a toothbrush). The cup 10 is attached to the supply bottle 42 via a bracket 30 that allows the cup 10 to be swiveled up to 90 degrees to fit into small sinks or spaces. The cup 10 material is flexible and can be temporarily deformed to allow the bristles to be brought up to a faucet 50. The bristles are gently forced upward into the faucet's spout 52 causing the cleaning liquid 68 to enter the faucet 50. The bristles 26 can be moved in a side to side motion to scrub away any mold residue. The faucet 50 is then turned on causing the cup to be filled with clean water and also rinsing the cleaning solution out of the cup 10.

It should be understood, of course, that the foregoing relates to exemplary embodiments of the invention and that modifications may be made without departing from the spirit and scope of the invention as set forth in the following claims.

What is claimed is:

1. A faucet cleaner comprising:

a supply bottle comprising a base, a sidewall extending from the base and a neck extending from the sidewall, wherein the neck comprises a top end comprising a rim forming an opening into the supply bottle;

a delivery cup pivotally secured to the neck by a pivot arm disposed within a pivot opening, wherein the delivery cup comprises a base and a sidewall extending from the base, wherein the sidewall comprises a top end comprising a rim forming an opening into the delivery cup;

a channel comprising a bottom end and a top end, wherein the bottom end is disposed in the supply bottle, wherein the channel runs from inside the supply bottle through the opening formed by the rim of the neck, through the base of the delivery cup, wherein the top end is disposed in the delivery cup; and a plurality of bristles secured to the base of the delivery cup and disposed within the delivery cup.

2. The faucet cleaner of claim 1, further comprising a bracket connecting the delivery cup to the supply bottle.

3. The faucet cleaner of claim 2, wherein the delivery cup pivots about a horizontal axis relative to the supply bottle.

4. The faucet cleaner of claim 3, wherein the channel is formed by:

a stem disposed in the supply bottle and having a top end secured to the rim of the neck;

a bracket channel connected to the top end of the stem;

a bracket tube connector extending from a top end of the bracket channel;

a flexible tubing comprising a bottom end connected to the bracket tube connector; and a supply tube comprising a supply tube connector at a bottom end and a nozzle at a top end disposed in the delivery cup, wherein a top end of the flexible tubing is connected to the supply tube connector of the supply tube.

5. The faucet cleaner of claim 4, wherein the supply tube comprises a closed top end and a plurality of openings positioned to deliver a liquid laterally into the bristles.

6. The faucet cleaner of claim 1, further comprising a single directional pump secured within the channel at the neck of the supply bottle.

7. The faucet cleaner of claim 1, wherein the delivery cup comprises a rubber elasticity.

8. The faucet cleaner of claim 1, wherein the sidewall of the delivery cup comprises a frusto-conical shape.

* * * * *